United States Patent [19]

Judge, Jr.

[11] 4,425,776

[45] Jan. 17, 1984

[54] PRODUCTION WORKPIECE STRAIGHTENING SYSTEM

[75] Inventor: Edward E. Judge, Jr., Lansing, Mich.

[73] Assignee: Industrial Metal Products Corporation, Lansing, Mich.

[21] Appl. No.: 85,466

[22] Filed: Oct. 17, 1979

[51] Int. Cl.[3] ..... B21D 3/16

[52] U.S. Cl. ..... 72/306; 72/12; 72/9; 72/27

[58] Field of Search ..... 72/306, 316, 12, 27, 72/9

[56] References Cited

U.S. PATENT DOCUMENTS

| | | | |
|---|---|---|---|
| 3,335,587 | 8/1967 | Blachut | 72/267 |
| 3,365,921 | 1/1968 | Dolney | 72/12 |
| 3,474,650 | 10/1969 | Judge et al. | 72/12 |
| 3,948,076 | 4/1976 | Eitel et al. | 72/12 |
| 4,144,730 | 3/1979 | Judge, Jr. | 72/12 |

*Primary Examiner*—Daniel C. Crane

[57] ABSTRACT

A production system for simultaneously correcting multiple distortions in multiple extensions of an irregular workpiece within tolerance requirements including for each distortion a gauge for determining direction and magnitude automatically employed to monitor corrective deflection beyond yield point under an electronic controller program which automatically initiates, controls, and terminates simultaneous corrective deflection in either or both of two planes at each of multiple workpiece locations. The program is adapted to vary with the relative as well as the individual distortions and to update the straightening program with the straightening experience data of each successive workpiece in order to approach an optimum of simultaneous single stroke corrective deflection of the multiple distortions in multiple planes within total workpiece tolerances.

21 Claims, 14 Drawing Figures

PRODUCTION WORKPIECE STRAIGHTENING SYSTEM

BACKGROUND OF THE INVENTION

Irregular workpieces such as steering knuckles for automotive vehicles have been straightened at a series of stations in accordance with my prior U.S. Pat. No. 4,144,730 issued on Mar. 20, 1979. Such steering knuckles involve steel forgings having a central spindle, substantially diametrically opposed steering and caliper arms projecting radially from the spindle normal to its axis and a third support arm extending normal to the caliper and steering arms as well as the spindle. Such steering knuckles are constructed as steel forgings wherein the respective arms are subject to substantial distortions through various causes including rough handling while hot and readily deformable. The arms must be straightened before machining in order to minimize the forging stock and weight of the finished workpiece. Distortions in the steering and caliper arms may occur in either direction in each of two principal planes while the support arm normally involves distortions in either direction in a single plane. In order to achieve automatic straightening in accordance with my prior patent, a steering knuckle was transferred through a series of successive straightening stations at each of which a single arm was straightened in either direction in a single plane. For example, at a first straightening station the left hand end of a caliper arm was straightened in a vertical direction; at the next station a right hand boss of the steering arm was straightened in a vertical direction; at the next the left hand end in a horizontal direction; and finally the right hand boss in a horizontal direction. At each station the steering knuckle was rigidly clamped with the axis of the spindle primarily located in proper orientation as well as the support arm to resist torsional rotation of the workpiece about the spindle axis as a result of straightening deflection stresses in the plane of the three arms. At each station a gauge was adapted to measure the initial distortion and monitor the straightening deflection under a program adapted to employ a controlled deflection stroke providing a variable corrective deflection stroke increasing with gauged distortion determined imperically and directed toward achieving single arm single plane straightening within tolerance with a single deflection stroke. A subprogram for further corrective deflection was also provided in cases where a single deflection was not adequate.

SUMMARY OF THE PRESENT INVENTION

The present production workpiece straightening system is an improvement over my prior patented system as applied to an irregular workpiece with multiple distortions each of which may require corrective deflection in either direction in more than one plane by rigidly clamping and simultaneously gauging critical locations of multiple extensions of the workpiece to which effective straightening deflections may be applied, and simultaneously applying corrective deflections in the directions and planes required, all at a single straightening station; also in automatically upgrading the program with straightening experience information from a number of successive workpieces, to more nearly optimize the potential for single stroke straightening at a single station whereas is normally the case, a given run of workpieces is likely to have batch similarities which may affect straightening characteristics such as reflected in variations in heat treatment, metallurgy etc. To implement the system a separate straightening ram head engaging each end of the steering and caliper arms of the steering knuckle is provided with tooling and power actuated slide means for deflecting the arm in either direction and in either or both of two planes simultaneously for both steering and caliper arms. The straightening tooling is moved over each arm extension with contact pads adapted to engage four sides of the projection. Such tooling is mounted in slides operating in perpendicular relation adapted to provide simultaneous deflection in either direction in both normal planes simultaneously for both steering and caliper arms. A compound gauge adapted to engage a corner of the arm extremity is adapted to actuate a transducer in each of two normal directions the signals for which control actuation of the slides to provide required deflection of each arm in both planes. A program is adapted to distinguish, particularly in the case of straightening in the plane of the respective arms, between distortions which require corrective deflection in opposite or the same circumferential directions where experience shows that a greater deflection amplitude is required to effect a given permanent yield when torsional forces are applied in the same circumferential direction. A program that stores information from the last five successive parts in each of a plurality of ranges of distortion in each of two planes for each of the caliper and steering arms provides data for determining initial stroke straightening deflection. In order to avoid undesirable overbending, the least of the five stored values of deflection beyond neutral is used for the initial stroke and any residual distortion, multiplied by an empirical factor, is added, or in the case of overbending substracted, from such stored value. Successive strokes which may be required to reach tolerance simply use the newly stored value rather than re-search for the lowest; or in the unusual case of overbending beyond tolerance, the lowest value in the range which includes the residual overbend distortion multiplied by a fractional factor which gives weight to the relatively lower deflection required to reach yield on a return from overbending.

BRIEF DESCRIPTION OF THE DRAWINGS

With reference to FIGS. 1, 2 and 3, the production workpiece in this case for illustrating the system, an automotive steering knuckle 20, has a steering arm 21, a caliper arm 22, a support arm 23 and a spindle 24. The required straightening for this steering knuckle may involve all three arms and in an actual machine built for an automotive vehicle manufacturer the support arm is straightened uni-directionally in a first straightening station in a manner similar to that disclosed in my prior U.S. Pat. No. 4,144,730, which accordingly does not form the subject matter of the present application, and the description of such station has been omitted.

Figure 1:
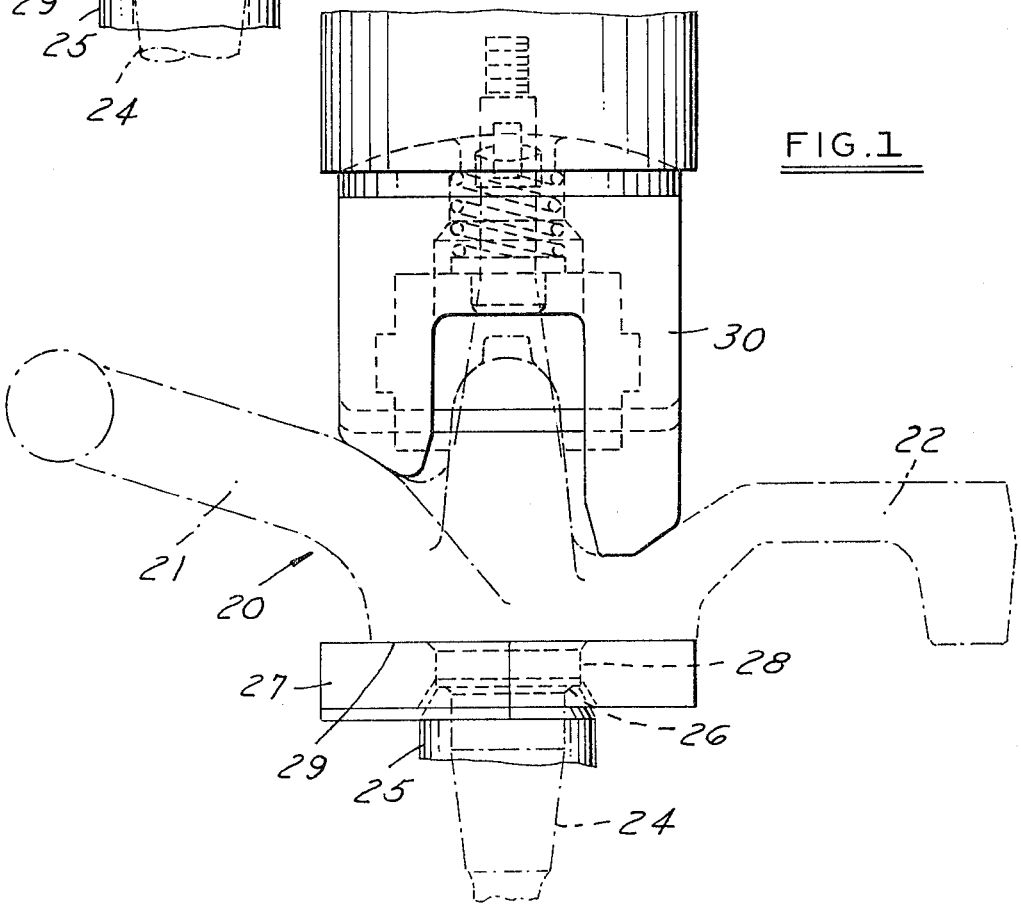
FIG. 1 is an end elevation of the central clamping pads and ram for the steering knuckle shown in phantom.

A single station multi-deflection simultaneous straightening of steering and caliper arm is involved in the present invention and requires the capability of gauging and deflecting both steering and caliper arms in both a vertical direction of the plane of FIG. 1 and in a horizontal direction at right angles to the plane of FIG. 1. The steering knuckle is automatically loaded by transfer mechanism, not shown, in a fixed locating sleeve 25 at the straightening station the upper end of which engages a shoulder 26 at the upper end of the spindle, and the knuckle is rigidly clamped by mechanism, later described in detail, with a split collar 27 engaging the outer perimeter 28 and providing support pads for the main shoulder 29 of the knuckle which is clamped from the top by vertically ram actuated tooling 30 adapted to engage irregular surfaces on the top of the knuckle. A wedge assembly 31 actuated by a separate ram engages the support arm 23 to resist torsional straightening forces imposed on the steering and caliper arm in the horizontal plane which are particularly severe when simultaneously imposed in the same circumferential direction about the axis of the spindle.

The present system as applied to the steering and caliper arms of the steering knuckle involves automatic gauging and programmed simultaneous deflection in each direction requiring straightening with an objective to straightening within tolerance with a single stroke.

Figure 3:
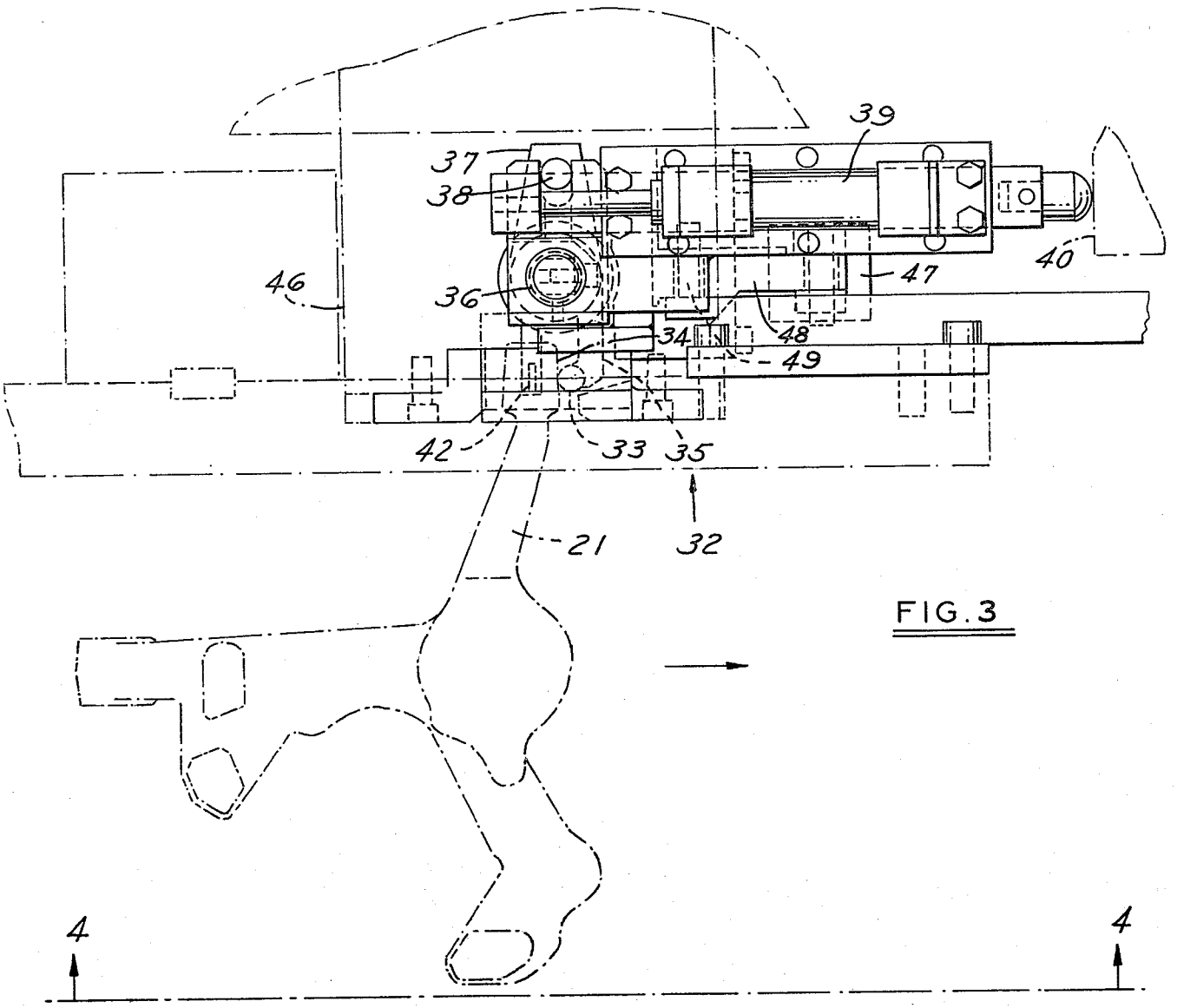
FIG. 3 is a fragmentary plan view showing gauging mechanism and ram position for engaging the boss of the steering arm.
Figure 3A:
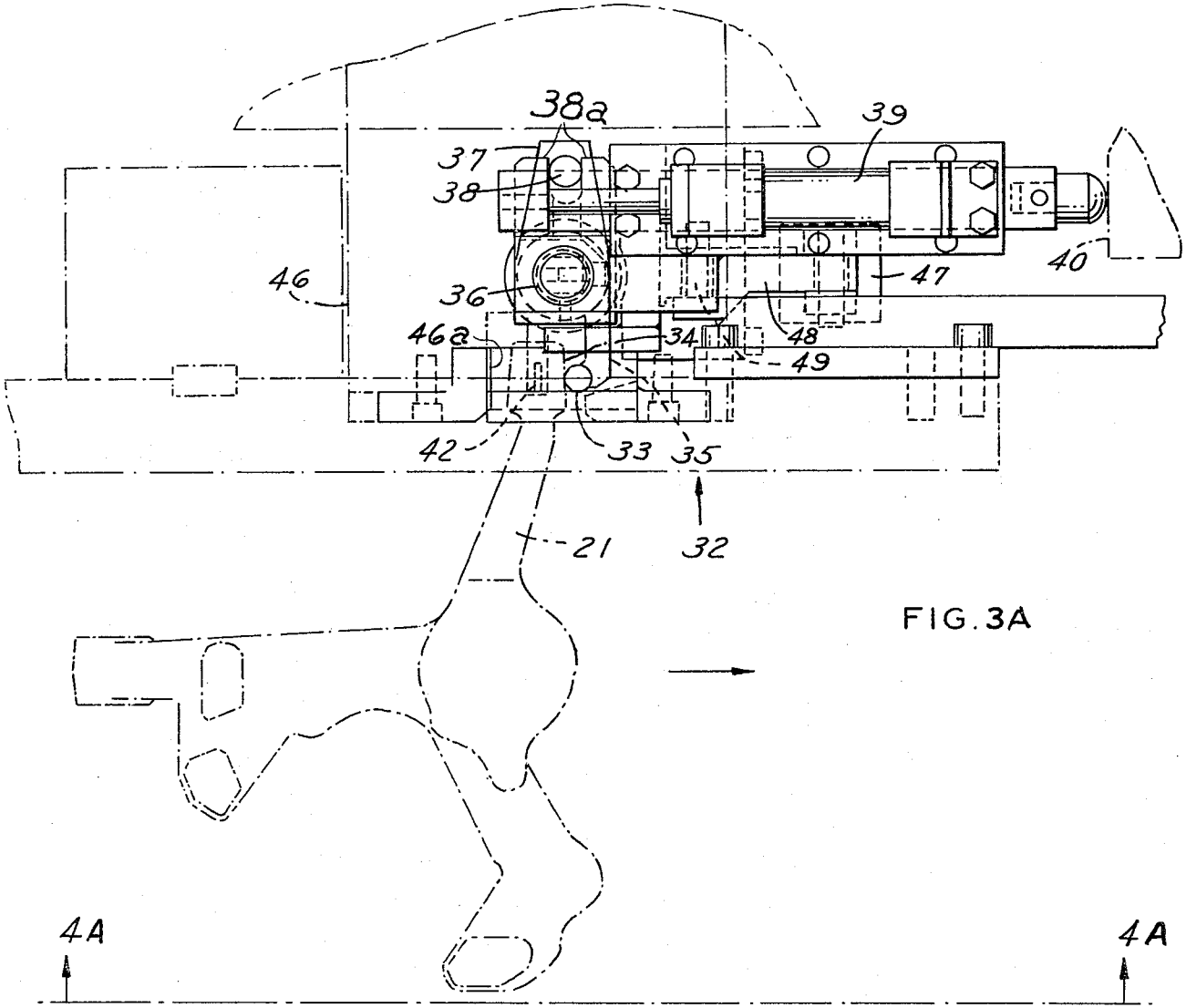
FIG. 3A is a view similar to FIG. 3 with the ram and its anvil components as well as the gauge linkage shown in full line to clarify their relationship.
Figure 4:
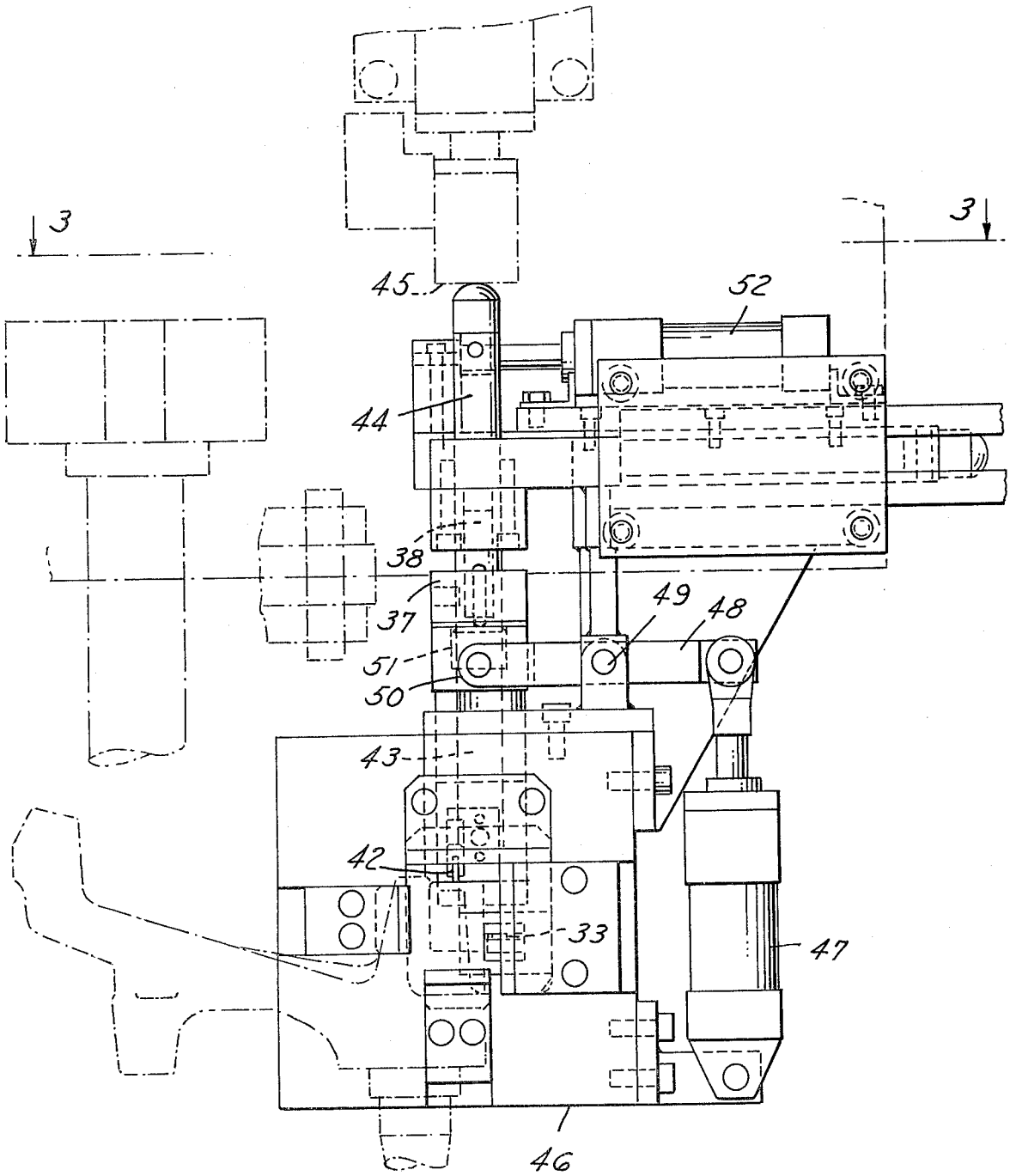
FIG. 4 is a side elevation taken along the line 4—4 FIG. 3.
Figure 4A:
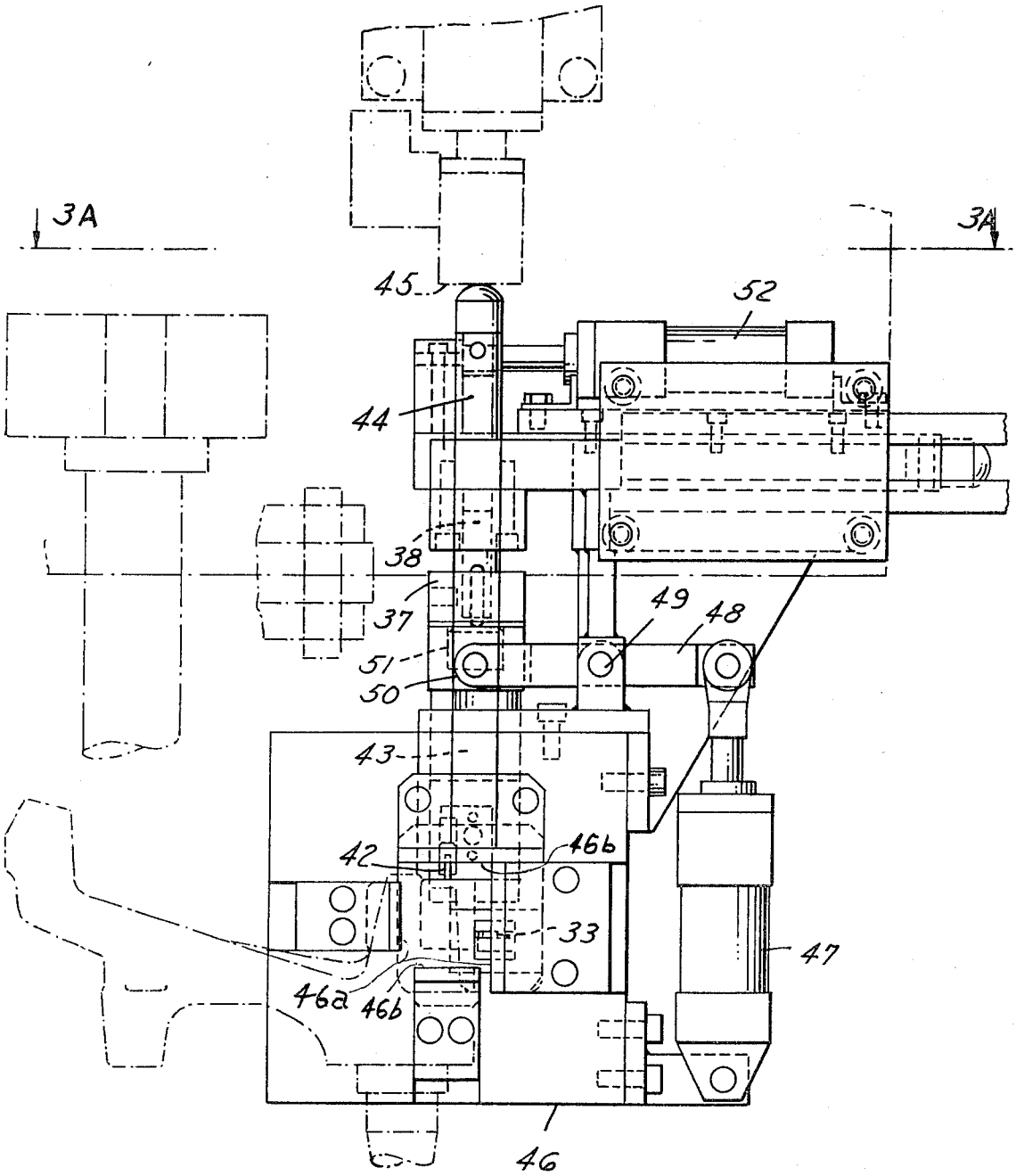
FIG. 4A is a view similar to FIG. 4 with the ram and its anvil components as well as the gauge linkage shown in full line to clarify their relationship.

With reference to FIGS. 3 and 4 the anvil and gauge head layout for the steering arm 21 is illustrated, it being understood that a similar anvil and gauge head is provided at the same station for the caliper arm. In operating position the head 32 includes gauge mechanism actuated by a hardened gauge disc 33 for engaging the lower boss 34 of the steering arm as seen in FIG. 3 to gauge the horizontal position and deflection of such boss in a horizontal direction as seen in FIG. 1. The disc 33 is mounted on gauge arm 35 pivotally mounted on bearing 36 and having an extension 37 carrying pin 38 adapted through yoke 38*a* to reciprocate an electrical transducer core 39 for effecting a plus or minus voltage signal relative to a fixed gauge surface 40 by which a variale analog voltage signal proportioned to the magnitude of a plus or minus distortion and straightening deflection may be monitored initially and throughout straightening deflection of the arm 21 horizontally in the plane of FIG. 3 by anvil surfaces 46*a*.

A second gauge disc 42 is adapted to register on the circumference of the steering arm boss to gauge and monitor deflection in a direction parallel to the axis of the spindle through longitudinal movement of a rod 43 concentric with the pivotal bushing for the arm 35 and in alignment with a transducer core 44 registering movement relative to a fixed gauge surface 45 and adapted to produce a plus or minus voltage signal proportional to the deviation from a null balance straight condition of the arm monitored initially and throughout straightening deflection of the arm in a direction normal to the plane of FIG. 3 (vertically in the plane of FIG. 4) by anvil surfaces 46*b*. The gauge assembly is mounted on a ram head 46 relative to which the gauge indicators are moved to their operative positions shown in FIGS. 3 and 4 by an air cylinder 47 acting through lever arm 48 pivoted at 49 and extending to a yoke 50 and collar 51 adapted to advance and retract the gauge indicator disc 42 to and from operative position and by an air cylinder 52 adapted to raise and lower the entire gauge assembly including indicator disc 33 relative to the steering arm boss. Positioning of the gauge indicator discs through air cylinders 47 and 52 into operative engagement with the steering arm boss occurs after the straightening ram has advanced to its operative position for straightening engagement with the steering arm boss.

Figure 2:
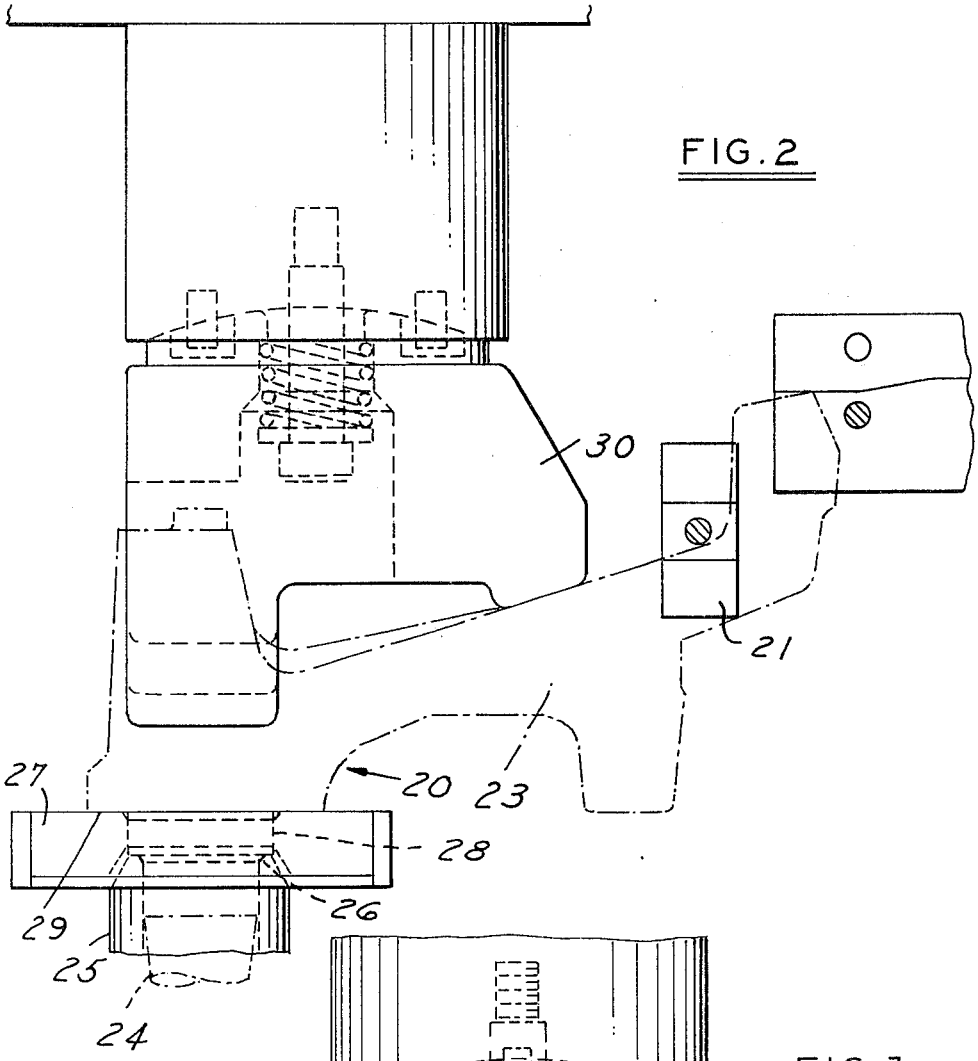
FIG. 2 is a side elevation of the clamping mechanism shown in FIG. 1.
Figure 5:
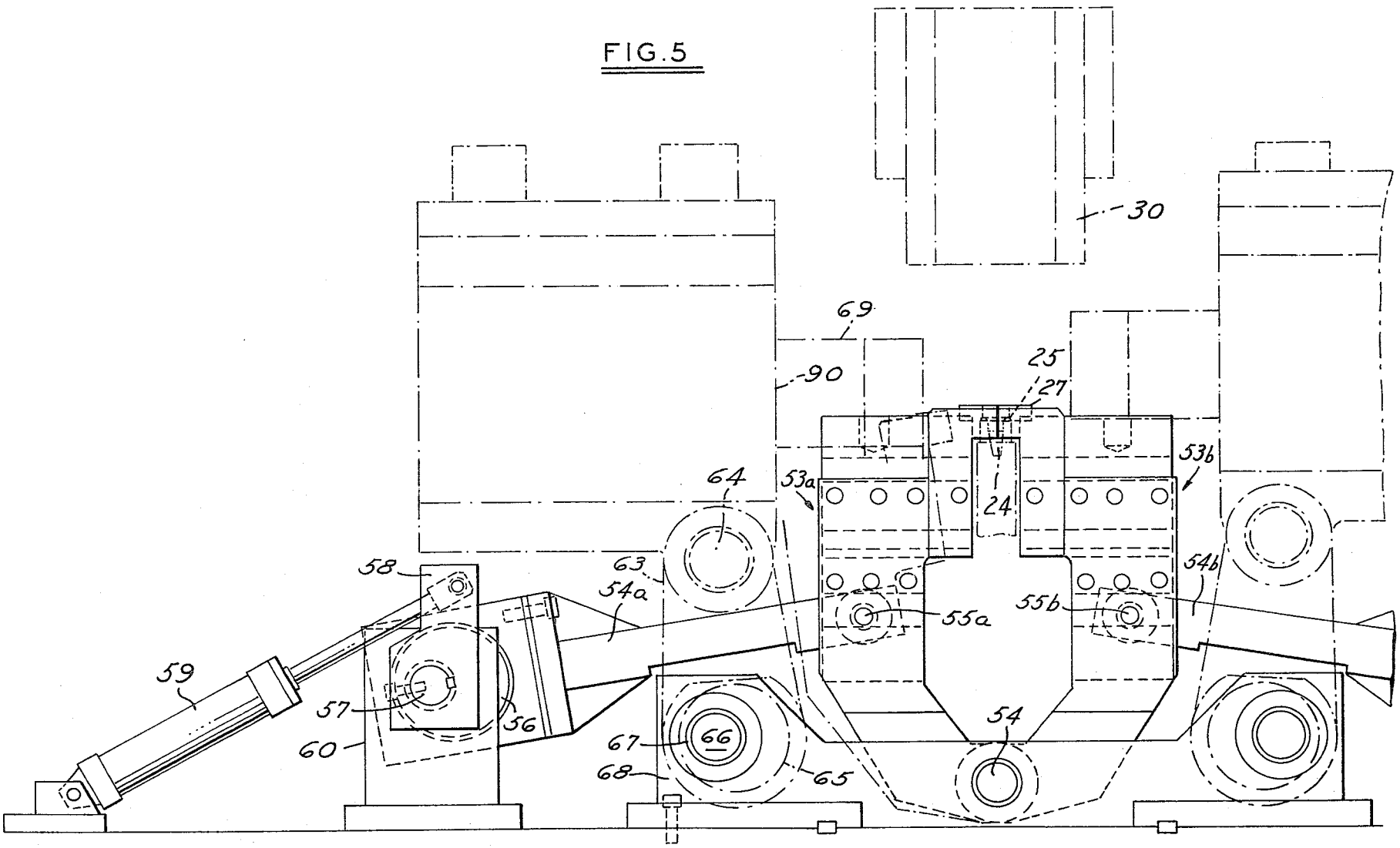
FIG. 5 is an end elevation of the clamping and straightening station.

Positioning of the ram occurs after clamping of the steering knuckle workpiece as shown in FIGS. 1, 2 and 5 wherein it will be seen that the split collar 27, best shown in relation with the steering knuckle in FIG. 1, is positioned on a pair of heavy arms 53*a* and 53*b* pivotally mounted at the base of the machine on a shaft 54 and actuated to a clamping position by a pair of links 54*a* and 54*b* pivotally pinned at 55*a* and 55*b* which are in turn actuated by a pair of eccentrics, one of which is shown at 56, driven by an actuating shaft 57 through arm 58 and power cylinder 59, the shaft 57 being anchored in bearings to a fixed reaction member 60. In clamped position the center line of the eccentric 56 is aligned with the center line of the actuating shaft 57 to provide an irreversible lock against any opening forces.

A clamping head 30 illustrated in FIG. 1 is actuated by a clamping ram schematically illustrated at the top of FIG. 5 and the straightening rams for the respective caliper and steering arms are schematically illustrated in relation to the clamping mechanism respectively at the left and right hand sides (reversed from the position shown in FIG. 1 which illustrates a right hand steering knuckle while the clamping mechanism is illustrated for a left hand steering knuckle). As illustrated in the left hand side the entire straightening ram assembly for the caliper arm is mounted in a standard vertical slide 62 and may be raised and lowered through link 63 pivotally connected to the straightening ram assembly at 64 and actuated by an eccentric 65 in an upward or downward direction through rotation of a drive shaft 66 mounted in shaft supports 67 on fixed reaction brackets 68 as hereinafter explained in detail with reference to other figures. The straightening rams may be extended and retracted between operating and transfer positions and when in operating position may be moved horizontally in a direction normal to the plane of FIG. 5 as well as vertically through the actuation of link 63 as required for staightening operations.

Figure 9:
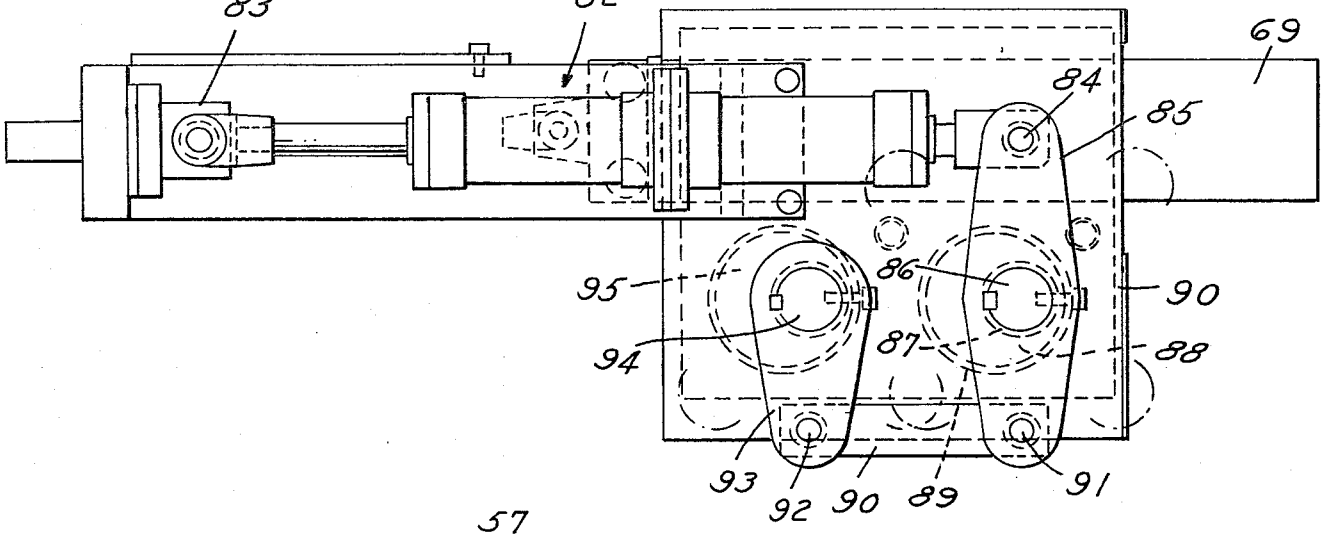
FIG. 9 is a plan view of the hydraulic-mechanical linkage shown in FIG. 8 and illustrating the linkage for effecting horizontal movement of the straightening ram.
Figure 5A:
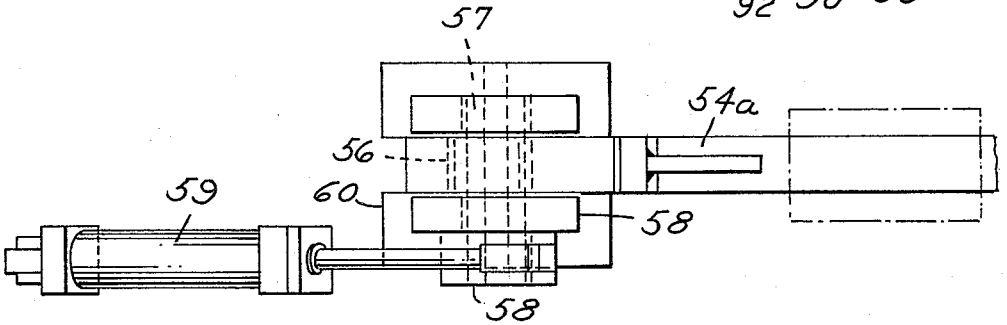
FIG. 5*a* is a fragmentary plan view of a portion of the hydraulic-mechanical linkage shown in FIG. 5.
Figure 7:
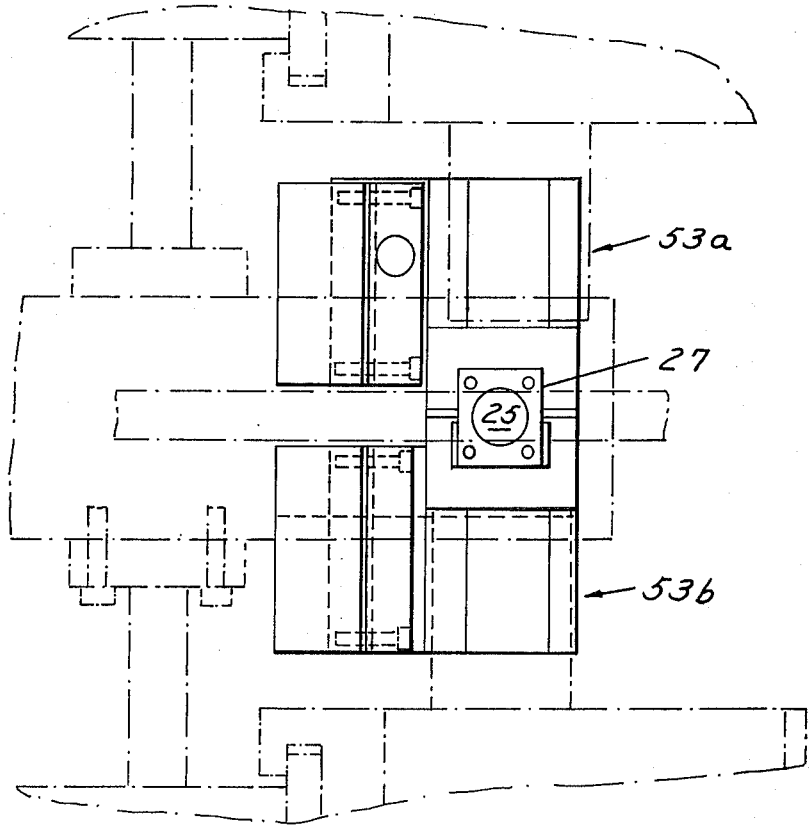
FIG. 7 is a fragmentary plan view of the station shown in FIG. 6.
Figure 6:
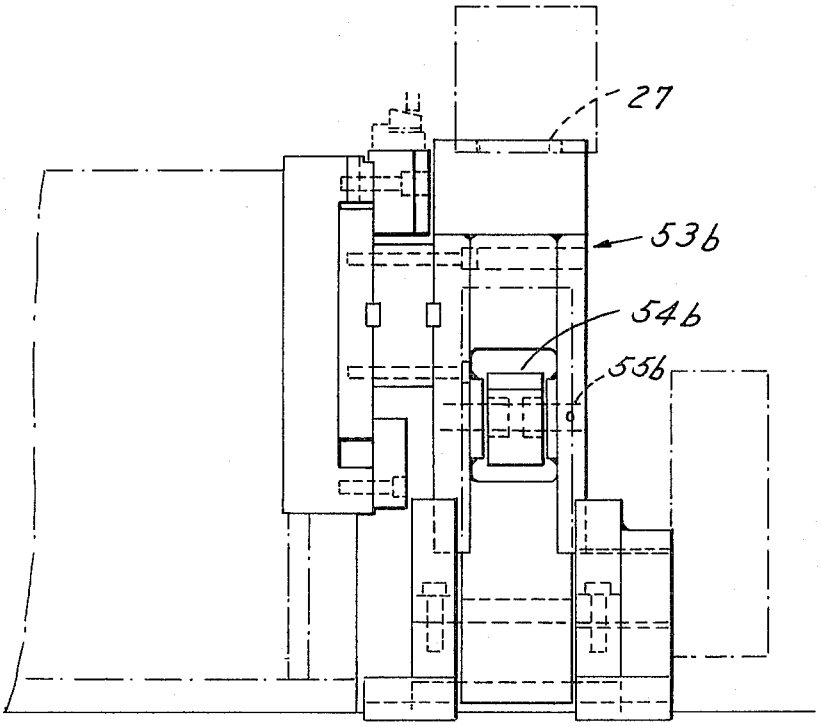
FIG. 6 is a fragmentary plan view of the station shown in FIG. 5.
Figure 8:
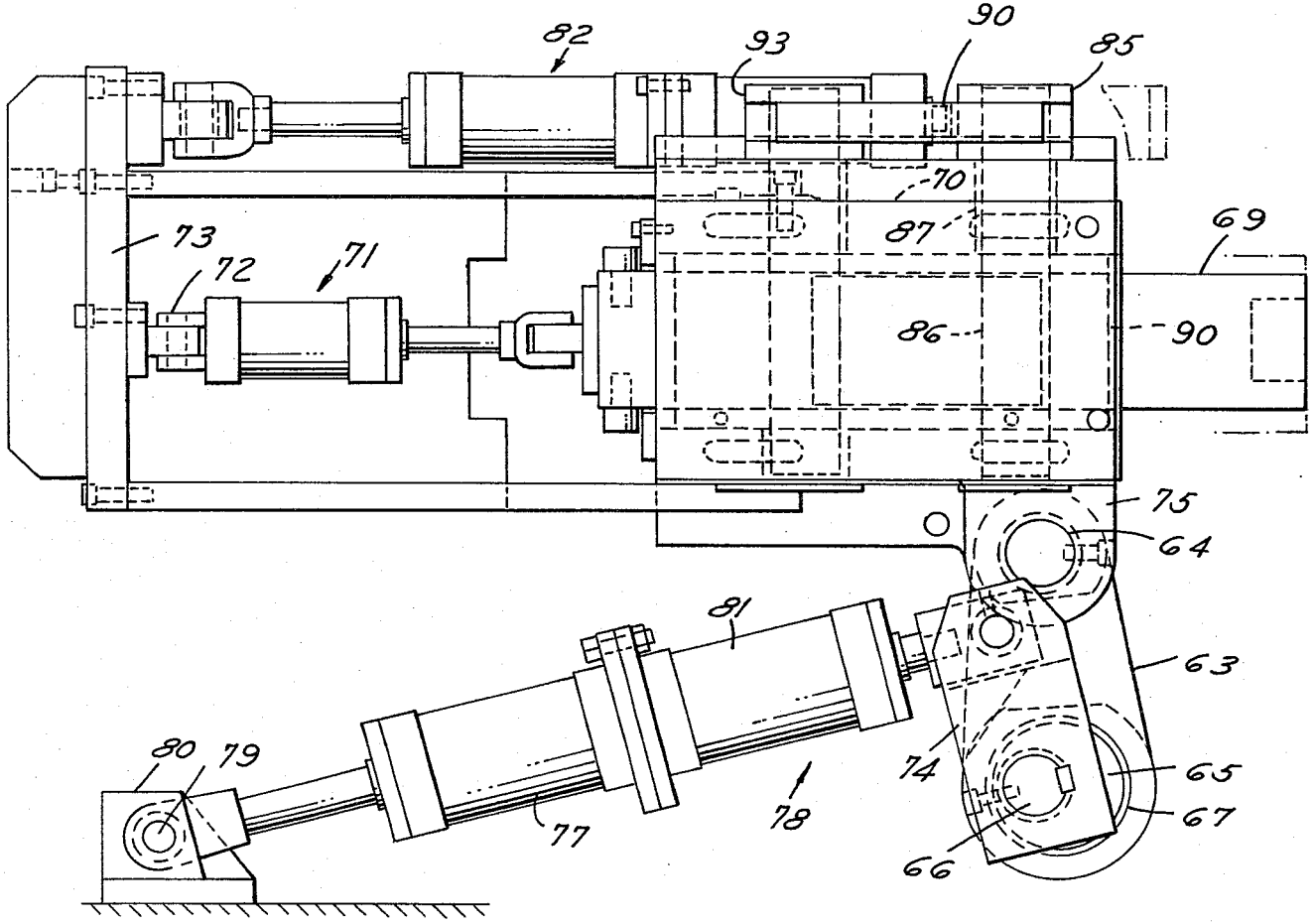
FIG. 8 is an end elevation of hydraulic-mechanical linkage for vertical actuation of the straightening ram shown in phantom in FIG. 5.
Figure 10:
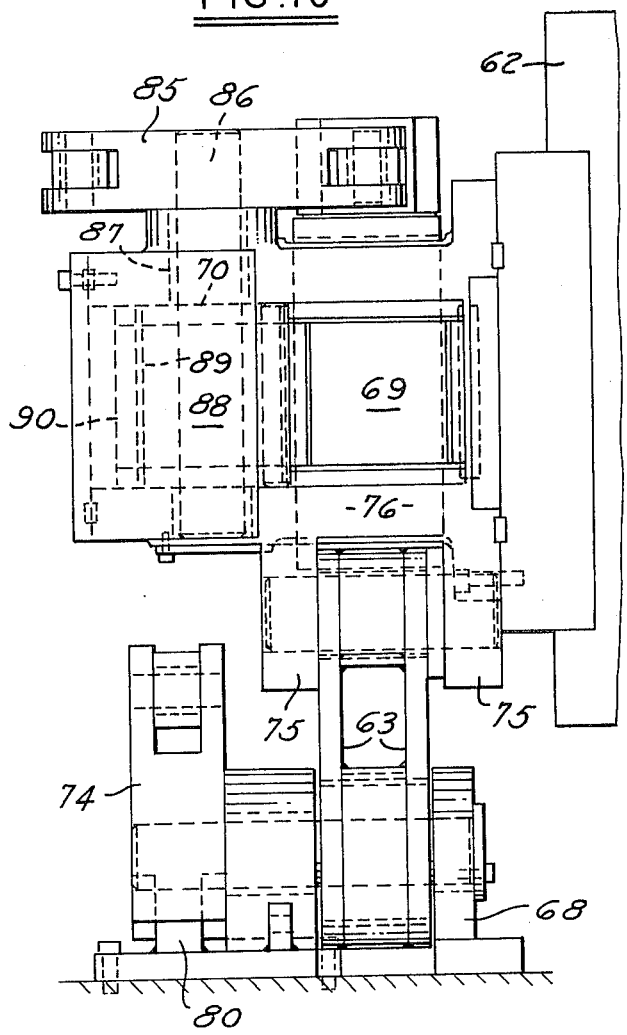
FIG. 10 is a side elevation of the hydraulic-mechanical linkage shown in FIGS. 8 and 9.
Figure 11:
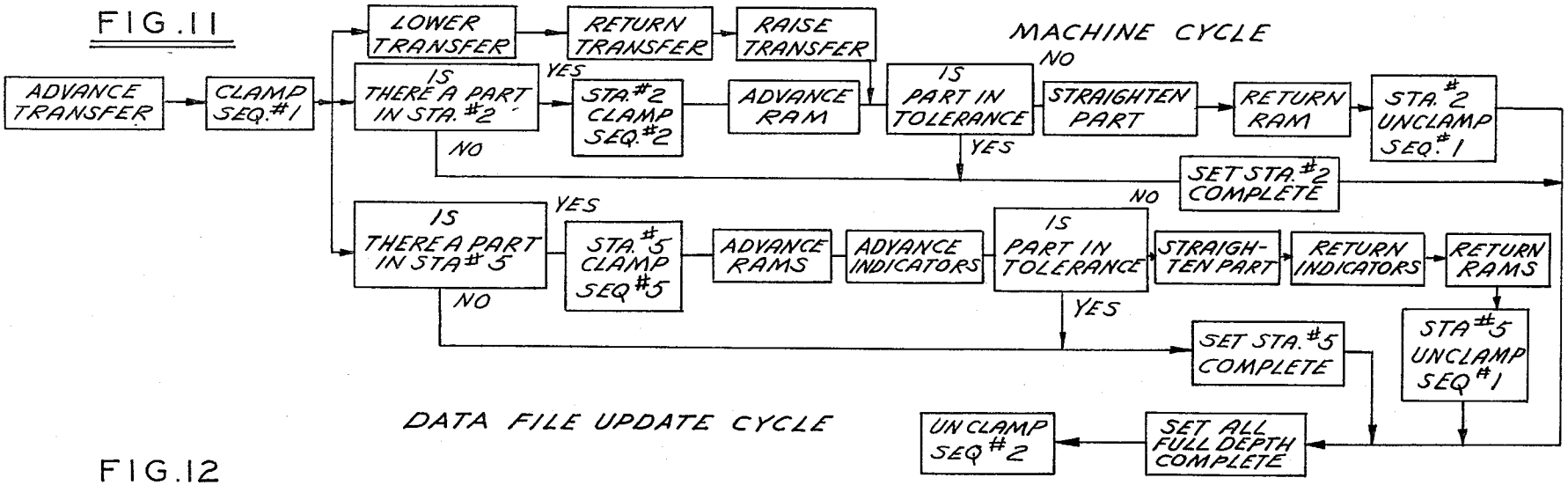
FIG. 11 is a schematic diagram of the machine cycle for complete straightening of a steering knuckle.
Figure 12:
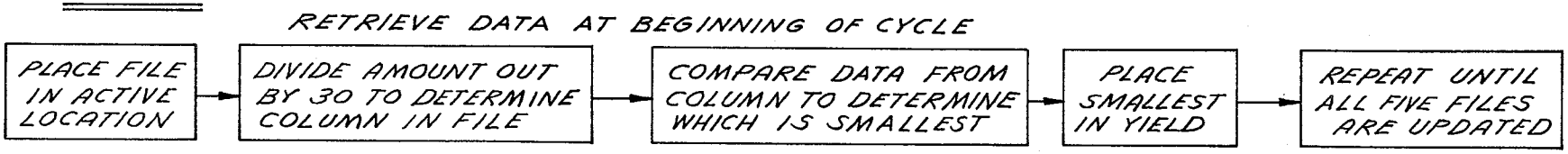
FIG. 12 is a schematic diagram of the Data File Update Cycle for the first straightening stroke.

With reference to FIGS. 5–10, and particularly FIGS. 8–10, tooling for engaging the head of the caliper arm is contained within the end of the square straightening ram head 69 carried within a rectangular ram head slide 70 actuated by a piston cylinder 71 anchored at 72 to a fixed mounting plate 73.

The rotation of shaft 66 to effect vertical movement of the ram assembly is effected through a link 74 raising the yoke 75 of slide assembly housing 76 when the left end 77 of a double acting piston cylinder assembly 78 anchored at 79 to a fixed bracket 80 is actuated to pull the link 74 in a counterclockwise direction; and is moved in a downward direction when the right end 81 is actuated to rotate the link 74 in a clockwise direction. The ram head 69 is actuated in the horizontal transverse direction by a double acting hydraulic piston 82 anchored at 83 to fixed bracket 73 and connected at 84 to a cross link 85 fixed to shaft 86 mounted in bushings 87 in the ram assembly housing 70 and drivingly connected to an eccentric 88 seated in a bushing 89 within the horizontal slide 70. A link 90 connected at 91 to an extension of the link 85 is drivingly connected at 92 to a link 93 adapted to rotate shaft 94 journalled similarly to shaft 86 and drivingly connected to eccentric 95 for effecting equal lateral movement of the slide in either lateral direction upon reciprocation of the link 85 through actuation of the double acting hydraulic piston cylinder 82.

A similar hydraulic mechanical system for actuating the straightening ram for the steering arm schematically illustrated in FIG. 5 is provided which, in combination with that illustrated in FIGS. 7–10 for the caliper arm provides the capability for imparting both vertical and transverse straightening deflection of the respective caliper and steering arms. The apparatus described is capable of simultaneous combined deflection in either vertical and/or horizontal direction for either or both arms as requirements indicated through gauging may prevail.

The basic gauging control as previously indicated reads initial distortion, if any, of both arms in either horizontal or in either vertical direction and monitors straightening deflection through four gauge heads which actuate four linear variable transducers each adapted to provide a zero null balance voltage signal at a nominal straight condition of the respective arms in the respective planes of gauging and to provide a plus or minus voltage signal increasing with displacement from the null balance position which analog signal is converted to digital values for which a commercially available controller may be programmed in accordance with the present system.

The general system of control is to electronically program any required straightening deflection beyond the nominal straight position and yield point of the material sufficiently to result in a straight condition upon springback and assumes metal materials for the workpiece capable of repeated deflections for a limited number of cycles without fatigue failure or undue weakening of the workpiece. It also assumes that some classes of workpieces may have batch straightening characteristics of successive workpieces with respect to uniformity of size, material composition, heat treatment and like factors which influence the extent of deflection required to reach yield in each direction of the various straightening planes; that a progressively greater deflection beyond the nominal yield deflection for a straight part will be required for progressively greater initial distortion; that in the case of workpiece such as the steering knuckle of the present embodiment a greater straightening deflection may be required when circumferential torsional stresses are imparted in the same clockwise or counterclockwise direction about the axis of the spindle, or in the plane of such axis due to yield of the clamp against torsional movement of the knuckle, and in the case of opposite circumferential straightening loads which tend to minimize clamp deflection; that straightening within tolerance for both arms should be attempted with a single simultaneous stroke of both rams in whatever vertical horizontal or combined diagonal direction may be required. The system is also based on the principal of programming the required deflection beyond the null balance position in accordance with initial and subsequent gauge readings and to monitor such deflection with the same gauge while hydraulic power actuates the ram until the programmed deflection is reached as indicated by the electrical gauge signal which operates to stop and release the hydraulic pressure to permit gauge reading of the arm straightener in a relaxed condition.

In order to approach single stroke straightening for all conditions of initial distortion in all potential directions, programs for the different planes of straightening corresponding to the four gauge displacements in either direction from null balance are subdivided into incremental ranges of initial distortion in steps, 0.030" each in the present embodiment up to a maximum of 0.270" with a final range of over 0.270". In each of such subdivisions initial deflection values are stored for the last five successive parts which fall within such subdivision. In order to minimize the potential for overbending on the initial straightening stroke the least deflection value for the last five parts is used for the first stroke and the initial distortion reading times an empirical factor, e.g. 120%, is added to determine the initial total stroke. Any remaining distortion in the same direction times such factor is added to the old lowest value and used for the second stroke with similar procedure for any successive strokes necessary to reach tolerance, subject to a reject limit such as five strokes.

If overbending beyond tolerance occurs, backbending from a corresponding range is programmed times a backbending factor, e.g. 80%, to allow for reduced resistance to reach yield.

Empirical factors for simultaneous bending of both arms in the same plane are also programmed, such as 130% for opposite bending (same clockwise or counterclockwise) and 60% for same direction bending (opposite clockwise or counterclockwise).

There may be some cases where batch characteristics and different range characteristics do not warrant updating storage data for the last plurality of parts. In such cases a program may be employed with a single empirically allocated deflection value for each of the straightening planes to which an initial distortion reading times a factor is added to determine the initial stroke.

With reference to FIGS. 11–14 the sequence of operations for machine cycle and control system are illustrated in block diagram steps. The Machine Cycle shown in FIG. 11 includes a Station #2 for straightening the support arm in a single plane which, as previously indicated, conforms to my prior patent and has not been disclosed in other figures of the drawings. The indicated Station #5 is that at which simultaneous straightening of multiple arms in multiple planes takes place in accordance with the present disclosure. The description of the sequence steps is self-explanatory, it being understood that after automatic clamping at Station #5, both rams advance, all four indicators advance and if straightening is required the sequence shown in FIG. 14 takes place. As a preliminary for determining the stroke in each of the four planes, the Data File Update Cycle shown in FIG. 12 takes place wherein one file at a time corresponding to each of the four planes of correction is supplied with any out of tolerance information, divided by 30 to determine the applicable range from which the smallest yield value is selected for use in the first straightening stroke. This cycle is repeated for all four planes (the fifth file being for Station #2) at which time the sequence shown in FIG. 14 takes place simultaneously for each of the four planes which may require deflection strokes. For each of such planes the stored transducer reading variance from null balance times an empirical factor is added to the smallest value of yield to determine the initial straightening stroke.

At this point stroke values are adjusted for relative direction of straightening of the two arms in the same plane as previously described. For a controller which does not read in negative values, the null balance may be set at a positive value such as 500 so that when an arm in the vertical plane is "high" the transducer set point is determined by subtracting the stroke from a stored transducer reading and if "low" by adding the stroke to the stored transducer reading. Likewise in the horizontal plane if the arm is "back" by subtracting the stroke or if the arm is "forward" by adding the stroke.

Figure 13:
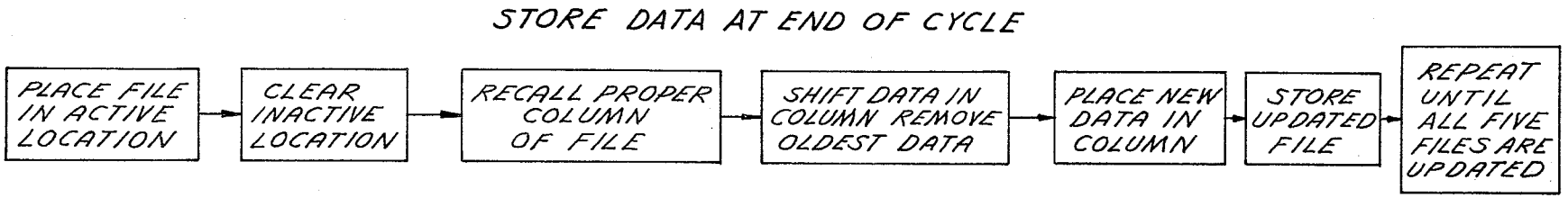
FIG. 13 is the Data File Update Cycle stored for the next part.
Figure 14:
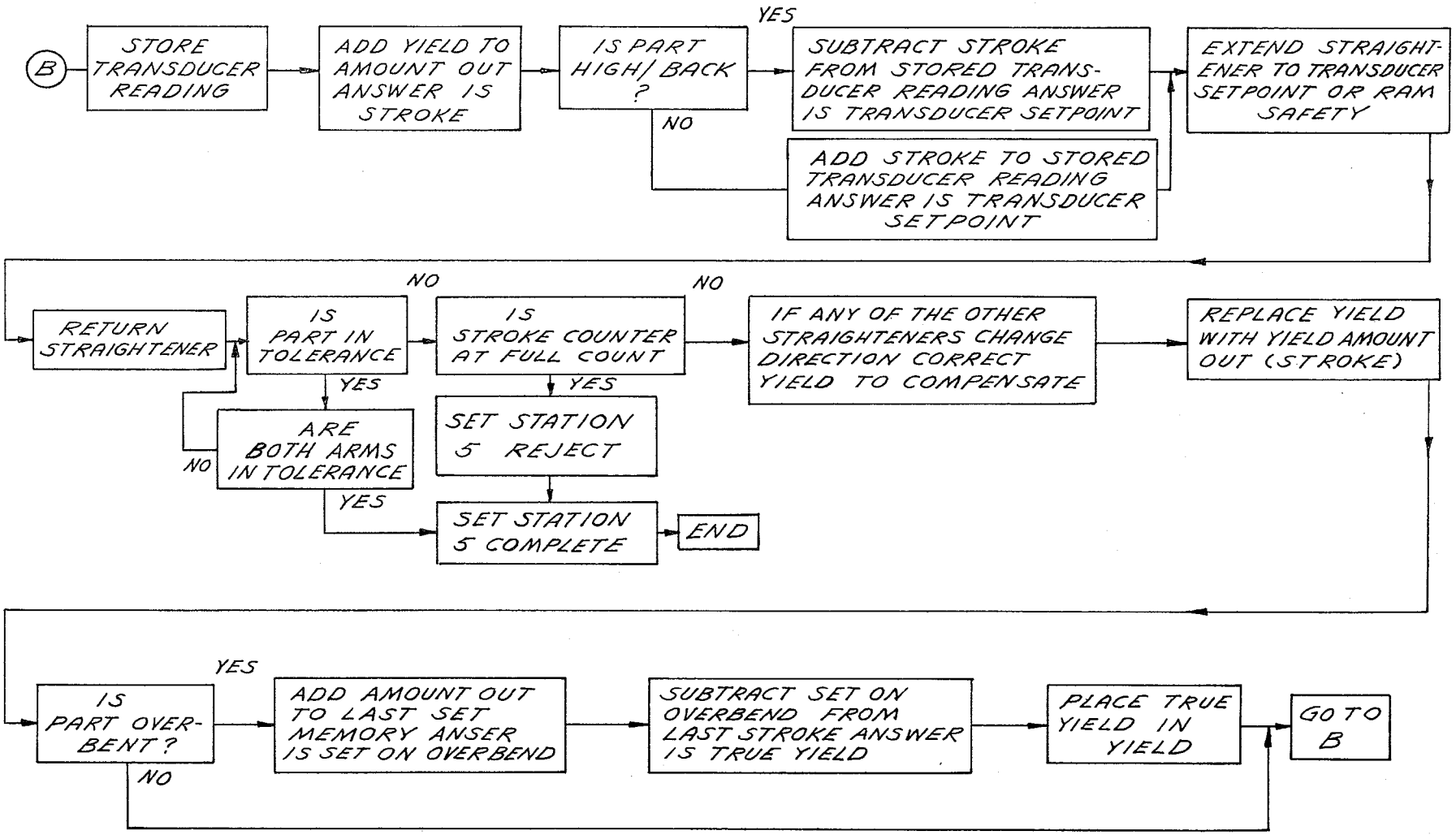
FIG. 14 is a schematic diagram showing the Sequence of Straightener Calculations for the multiple straightening operation station.

With all four transducer set points established the straightener rams are simultaneously actuated to the respective transducer set points and returned for gauge readings as to part tolerance. If further straightening is required and the stroke counter has not reached a full count, the relative direction is again compared to determine if any change in direction requires compensation and the yield value which was used is replaced with a new value reflecting remaining distortion times a factor. If the part is overbent in any of the planes of correction, the amount "out" is added to the last set memory and the answer is set on "overbend". The amount of overbend times a factor is subtracted from the last stroke to provide a new minimum yield value for use in the second stroke and for storage for the next part as shown in FIG. 13. Thus, in case the part is not in tolerance in any plane after the first stroke, a new stored value is established by adding in the case of underbend or subtracting in the case of overbend following which such new value is stored in the data file while the earliest previous value is discarded. The new value if reflecting an overbend will continue as the smallest value but in the case of underbend may or may not continue as a new smallest value.

It will be understood that while the present straightening system has been disclosed in detail with regard to the specific example of straightening simultaneously two arms of a steering knuckle in two different planes, the system may be equally applied to other workpieces having separate distortions requiring separate straightening action which may involve multiple plane straightening requirements and may involve an interrelation of different required straightening strokes depending on the relative direction of distortion.

I claim:

1. A straightening system comprising means for straightening production quantities of workpiece having a plurality of potential distortions including means for immovably clamping said workpiece at a single straightening station in fixed relation relative to said station, separate gauging means for simultaneously gauging the direction and magnitude of each of said distortions, and automatic power operated deflecting means at said station for simultaneously effecting straightening of said distortions, including means for simultaneously moving said deflecting means in a plurality of different planes at said single station thereby straightening said distortions.

2. A system as set forth in claim 1 including means for simultaneously gauging each of said plurality of potential distortions in different planes, and means for simultaneously straightening said distortions as required in said plurality of different planes.

3. A system as set forth in claim 2 wherein said gauging means include means to monitor straightening deflection and control the extent of deflecting stroke.

4. A system as set forth in claim 1 including variable program means for straightening deflection in the initial straightening stroke in accordance with gauge indicated requirements reflecting magnitude and direction.

5. A system as set forth in claim 4 including different variable program means reflecting different relative direction of straightening respective distortions.

6. A system for straightening production quantities of a workpiece having a main body and a plurality of potential extension distortions in a plurality of different planes, means for immovably clamping said main body at a single straightening station in fixed orientation relative to said station, automatic means at said single station for gauging the direction and magnitude of each of said extension distortions in each of said planes, automatic power operated workpiece extension deflecting means at said single station for each of said extension distortions adapted to produce workpiece extension deflection beyond yield in the plane of and in a direction opposite to said gauged distortion while said main body remains rigidly clamped at said single station including means for simultaneously operating the deflecting means in a plurality of different planes at said single station thereby straightening said distortions.

7. A system for workpiece straightening as set forth in claim 7 wherein said automatic power operated workpiece extension deflection means includes means to operate simultaneously in each of two planes for each of said extension distortions.

8. A system as set forth in claim 7 for straightening a steering knuckle workpiece having separate arms each potentially requiring straightening in either direction in either of two separate planes.

9. A system for workpiece straightening as set forth in claim 9 wherein said automatic power operated workpiece extension deflecting means includes a workpiece engaging means movable to deflect said extension in either of two perpendicular planes, a fixed frame, a slide mounted on said frame actuated by said automatic power operated means to effect deflection of said workpiece engaging means in one of said planes, cross slide means mounted on said first slide means for effecting workpiece extension deflection in the other of said planes, said automatic power operated means including separately controllable power means for effecting simultaneous controlled actuation of said slide and cross slide means.

10. A system for workpiece straightening as set forth in claim 9 including dual gauge means for simultaneous gauging and monitoring of deflection effected by simultaneous actuation of said slide and cross slide means.

11. A system for workpiece straightening as set forth in claim 9 including hydraulic cylinder means for actuating said slide in either direction, and separate hydraulic cylinder means for actuating said cross slide in either direction.

12. A system for workpiece straightening as set forth in claim 8 wherein a separate slide and cross slide is provided for each of separate arms of said steering knuckle workpiece.

13. A system for workpiece straightening as set forth in claim 9 wherein said automatic power operated workpiece extension deflecting means includes eccentric means actuated by hydraulic power cylinder means.

14. A system for workpiece straightening as set forth in claim 6 including variable program control means based on stored information automatically reflecting the experience of previously straightened parts.

15. A system for workpiece straightening as set forth in claim 6 including variable program control means based on stored information automatically reflecting the experience of previously straightened parts and including stored information segregated in a plurality of ranges of gauged distortion.

16. A system for workpiece straightening as set forth in claim 6 including variable program control means based on stored information automatically reflecting the experience of previously straightened parts and including stored information segregated in a plurality of ranges of gauged distortion, the stored information from a plurality of the last gauged parts within a given range providing a minimum yield value which together with the initially gauged distortion provides a basis for an initial corrective deflection stroke.

17. A system for workpiece straightening as set forth in claim 8 wherein said program for corrective deflection includes a variable factor reflecting different relative directions of corrective deflection required in the same plane for the respective arms.

18. A system for workpiece straightening as set forth in claim 8 wherein said program for corrective deflection includes a variable factor reflecting different relative directions of corrective deflection required in the same plane for the respective arms providing greater corrective deflection in opposite directions (same circumferential) than in the same direction (opposite circumferential).

19. A system for workpiece straightening as set forth in claim 16 wherein the remaining error after the first corrective deflection stroke is used to modify the lowest value of yield stored for the last of a plurality of parts within the range involved.

20. A system for straightening production quantities of a workpiece having a main body and a plurality of potential extension distortions in a plurality of different planes comprising; a straightening machine having a fixed frame, means for immovably clamping said main body in fixed precise orientation relative to said frame at a single station, automatic means at said station for gauging the direction and magnitude of each of said extension distortions in each of said planes, and automatic power operated workpiece extension deflection means at said single station for each of said extension distortions adapted to produce workpiece extension deflection beyond yield in the planes of and in directions opposite to said gauged distortions while said main body remains rigidly clamped at said single station including means for simultaneously operating the defecting means is a plurality of different planes at said single station thereby straightening said distortions.

21. A system as set forth in claim 20 including means for straightening a steering knuckle workpiece having separate arms each potentially requiring straightening in either direction in either of two separate planes.

* * * * *

UNITED STATES PATENT AND TRADEMARK OFFICE

CERTIFICATE OF CORRECTION

PATENT NO. : 4,425,776

DATED : January 17, 1984

INVENTOR(S) : Edward E. Judge, Jr.

It is certified that error appears in the above–identified patent and that said Letters Patent are hereby corrected as shown below:

Claim 7, line 2, change "7" to --6--.

Claim 9, line 2, change "9" to --7--.

Signed and Sealed this

*Eighth* Day of *May 1984*

[SEAL]

*Attest:*

GERALD J. MOSSINGHOFF

*Attesting Officer*

*Commissioner of Patents and Trademarks*